US007344639B1

(12) United States Patent
Meincke

(10) Patent No.: US 7,344,639 B1
(45) Date of Patent: Mar. 18, 2008

(54) SWIMMING POOL CIRCULATION SYSTEM

(76) Inventor: Jonathan E. Meincke, 1101 Sparkleberry La. Extension, Columbia, SC (US) 29203

( * ) Notice: Subject to any disclaimer, the term of this patent is extended or adjusted under 35 U.S.C. 154(b) by 245 days.

(21) Appl. No.: 11/205,960

(22) Filed: Aug. 17, 2005

(51) Int. Cl.
*E04H 4/12* (2006.01)

(52) U.S. Cl. ..... 210/167.1; 210/167.12; 210/416.2; 4/507

(58) Field of Classification Search ..... 210/167.01, 210/167.1, 167.12, 416.1, 416.2; 4/507
See application file for complete search history.

(56) References Cited

U.S. PATENT DOCUMENTS 1,670,094 A * 5/1928 Becker ..... 210/123
2,617,764 A * 11/1952 Hauber et al. ..... 210/167.13
3,242,503 A * 3/1966 Russo ..... 4/495
4,640,784 A * 2/1987 Cant ..... 210/776
6,022,481 A * 2/2000 Blake ..... 210/776
6,280,639 B1 * 8/2001 Ortiz ..... 210/776
6,419,840 B1 * 7/2002 Meincke ..... 210/767
7,300,576 B1 * 11/2007 Blake ..... 210/167.1
2005/0066435 A1 * 3/2005 Barnes et al. ..... 4/507

* cited by examiner

*Primary Examiner*—Fred G. Prince
(74) *Attorney, Agent, or Firm*—Michael A. Mann; Nexsen Pruet, LLC

(57) ABSTRACT

A swimming pool water circulation system includes up to two sets of at least two active main drains connected to a "Y" or a "double Y" connector and then, via a single line, to a single canister filter. Jet nozzles arranged in at least one bank on the pool walls use return water to sweep sediment down the pool walls and to cause a vortical flow of the water above the drains. The additional main drains can be deployed closer to the pool walls where they can better intercept sediment from the jet nozzles. Up to two pumps can service each canister filter. Additional suction may be obtained by diverting a portion of the water from the pressure side of the filter through a venturi in the canister filet housing. Additional components and valves managed by a controller can facilitate sequential cleaning of the pool by zones during normal operation without unduly affecting normal filtration of pool water and can provide for additional cleaning via robotic devices.

21 Claims, 8 Drawing Sheets

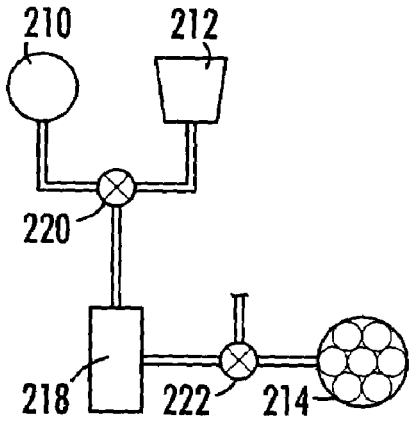
FIG. 9A
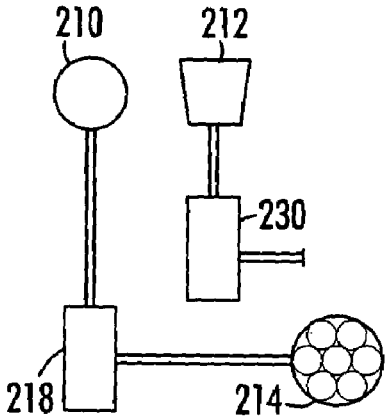
FIG. 9B
FIG. 10
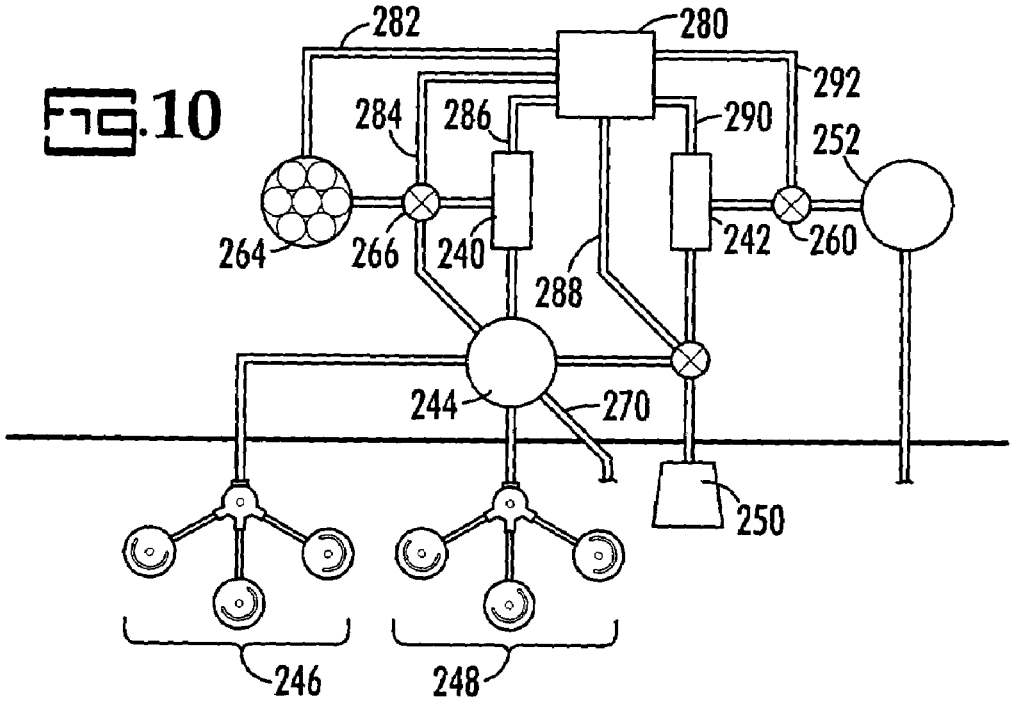

SWIMMING POOL CIRCULATION SYSTEM

CROSS REFERENCE TO RELATED PATENTS

Application Ser. Nos. 11/109,599 filed Apr. 19, 2005, and 11/215,460 filed Aug. 30, 2005, are related to the present application in that they are commonly owned by the inventor and disclose subject matter related to swimming pool circulation systems. The companion applications are incorporated herein by reference.

BACKGROUND OF THE INVENTION

The present invention relates to swimming pool circulation systems and to the design of circulation systems that are better able to remove particulate from the water of the pool.

The technology for maintaining the clarity and cleanliness of swimming pool water has developed significantly over the past 50 years. Currently, most new pools have at least three filters. There is a first filter for removing fine, suspended particulate such as dust and bacteria. This filter is typically a tank containing sand or diatomaceous earth. There is a second filter for capturing floating debris, such as leaves and twigs. This second filter is called a skimmer because it is located along the side of the pool where it skims floating debris from the surface of the pool water and readily separates it using a coarse mesh basket.

Typically, swimming pools also have a third filter, called a canister filter, for capturing sediment and heavier debris, such as water-logged leaves, from the bottom of the pool. This filter is positioned in line between the main drain of the pool, commonly located near the lowest point in the pool, and the suction side of the pump.

The canister filter contains a strainer or fine-mesh bag-like sieve to trap sediment that is then periodically removed by the pool caretaker.

As the number of residential pools has increased, the complexity of the design of residential pools has also evolved. The residential pool owner demands easier and more automatic systems to care for the pool. While skimmers and suspended matter filters generally do a good job of removing floating and suspended debris and dirt, bringing sediment to the canister filter requires more effort.

Unlike suspended and floating matter, sediment does not travel with the water in the pool. Although some sediment is sucked into main drains, much may accumulate in dead zones of the pool. Originally, to remove sediment that has not been sucked into a main drain, a pool floor was vacuumed by hand, perhaps daily, depending on how often the pool was used. Subsequently, robotic vacuuming systems were introduced to automate the vacuuming of the bottom of the pool. This improvement eliminated tedious hand vacuuming but still left it to the pool owner to set up, take down and monitor the robots. More recently, pop up wall and floor jets have been employed to sweep sediment to the main drain located in the deepest part of the pool. These improvements reduce the frequency at which robotic vacuum systems or manual vacuum systems have to be used but sediment may still find dead zones in the pool where it will accumulate.

Coincident with the interest in pool circulation systems that make it easier to take care of pools, concerns have arisen over entrapment and entanglement of swimmers by main drains. The powerful suction of main drains can entangle hair and clothing and can entrap small children. As a consequence, additional passive main drains have been added to provide suction relief in the event an active main drain is blocked. In some cases the additional drains are also active rather than passive and assist in pool sediment removal. Relief ports and other technical improvements have been added to main drains to reduce the likelihood of entrapment and entanglement.

However, there remains a need for a better way to keep pools clean, and to manage the sediment collection in particular.

SUMMARY OF THE INVENTION

The present invention is a water circulation system for a swimming pool and a method for designing a circulation system for a swimming pool. According to one of its major aspects, the circulation system includes several components that individually and collectively provide new tools to the swimming pool designer that facilitate the design of custom pools, particularly those with complicated shapes. These components include sets of pool floor drains, preferably in a set of at least two drains, preferably two or three drains, connected to the water circulation system via a "Y" or "double Y" connector and then to a single common line running to a canister filter. This arrangement, which permits additional drains to be easily added to a swimming pool, allows the pool designer to place drains closer to wall jet nozzles so that sediment blown down the sides of the pool by these jets is more readily drawn into the drains and processed in accordance with the balance of the circulation system.

Another component that facilitates the design of custom pools is the canister filter described in one of the companion applications. This canister filter can serve two pumps and two sets of multiple drains and may, in an alternative embodiment, have a venturi formed in it for increasing suction. All of the sediment from up to six drains (two sets of three drains, for example) can be brought to a single canister, for example, to simplify the task of removing sediment and to offer the pool designer flexibility in terms of the number of pumps, canisters and valves needed to operate active main drains, wall jets, robotic cleaners, skimmers and circulate the pool water through the piping and filters in the sequence and with the pressure needed to keep the pool clean.

Another component that improves pool water circulation and, accordingly, the cleanliness of the pool water, is the use of horizontally directed, constant flow jet nozzles positioned on the pool wall above main drains. These jets are offset or eccentrically located so as to direct water in a vorticular flow over the main drain to help draw sediment to the main drain.

The combination of sets of drains and a canister adapted to serve multiple sets of drains and to be served by two pumps gives the pool designer additional flexibility in designing pools, particularly those pools with irregular shapes. Because of their irregular shapes, one or two main drains may not be sufficient to remove sediment. Moreover, having available a greater number of drains allows the designer the ability to put each drain closer to the wall where it can intercept sediment swept down the pool walls by wall jets. As a result, even irregularly shaped, custom-designed pools can be kept cleaner with less effort by the pool owner.

Another feature of the present invention is the use of valves and pumps in various combinations to direct water from one component to another. For example, the pool may have two basic modes of operation: a steady-state mode and a cleaning mode. During the cleaning mode, the wall jets are activated in groups that define zones. A zone is a group of wall jets that operate in concert to sweep sediment down a portion of the pool wall. Using pumps or valves, or combinations of pumps and valves, the pool designer can design a pool water circulation system in which the cleaning sequence switches automatically from one zone to another, and one mode of operation to another, with minimal burden on the pool owner.

Still another feature of the present invention, particularly in view of commonly owned U.S. Pat. Nos. 6,419,840, 5,107,872, 4,907,610, and 4,828,626, which are incorporated herein in their entirety by reference, is the fact that these other inventions that use pop-up floor jets cannot simultaneously use pressure-driven or suction-powered robotic cleaners because the pop-up heads will blow the robotic cleaners off the floor of the pool, thus negating the usefulness of the robotic cleaners in enhancing the cleaning of the pool. In the present invention, on the other hand, the main drains can be in full operation simultaneously with the robotic cleaners without interference. Additionally, because the water supplied to the pressure-driven robotic cleaners has already been filtered by the canister, the outflow of a standard centrifugal pump can be used directly to power the robotic cleaner, without first filtering the water through the pool's filter and then having to increase the pressure of the filtered water via an additional booster pump.

These and other features and their advantages will be apparent to those skilled in the art of swimming pool water circulation system design from a careful reading of the Detailed Description of Preferred Embodiments accompanied by the following drawings.

BRIEF DESCRIPTION OF THE SEVERAL VIEWS OF THE DRAWINGS

In the drawings,

FIGS. 9A and 9B are details of two alternative, equivalent water circulation systems for a swimming pool, according to a preferred embodiment of the present invention;

FIG. 10 is a schematic view of a water circulation system for a swimming pool according to a preferred embodiment of the present invention.

DETAILED DESCRIPTION OF THE INVENTION

The present invention is a water circulation system for a swimming pool and a method for designing a water circulation system for a pool. Although the present water circulation system employs many of the same components as prior art water circulation systems—components such as pumps, valves, piping, drains, canister filters and jet nozzles—the selection and arrangement of the components achieves a higher state of cleanliness with less effort by the pool owners, and allows greater flexibility for pool designers in creating designs. Furthermore, several of the components are not found in the prior art, namely, a set of main drains commonly connected to a canister, and the canister itself. The canister is the subject of a commonly-owned, pending patent application.

The phrase "water circulation system" is intended to refer not only to the pumps and piping that cause the water to circulate into and out of a swimming pool but also to the filters, main drains, wall jets, robotic cleaners, skimmers, and controls that process pool water, and help to separate sediment and floating debris from the water and return it to the pool. Since the primary purpose of circulating the water in the pool bowl is to clean it, these are all properly included.

The word "line" means a pipe or conduit for moving water from one component to another and will be used interchangeably with pipe, piping and conduit. In some cases, electrical connections to a controller will be described and the word "line" in that context will refer to an electrical conductor.

A swimming pool itself is a bowl dimensioned for swimming and having any desired shape, either regular or irregular. The bowl has an interior that will hold a quantity of water suitable for the type of use the owner intends and will have a floor and a wall. The floor and wall may meet at a right angle or the wall may join the floor in a curve for a smooth transition, which is preferred. The top edge of the pool may be finished in tile, concrete or a combination of both.

Figure 1:
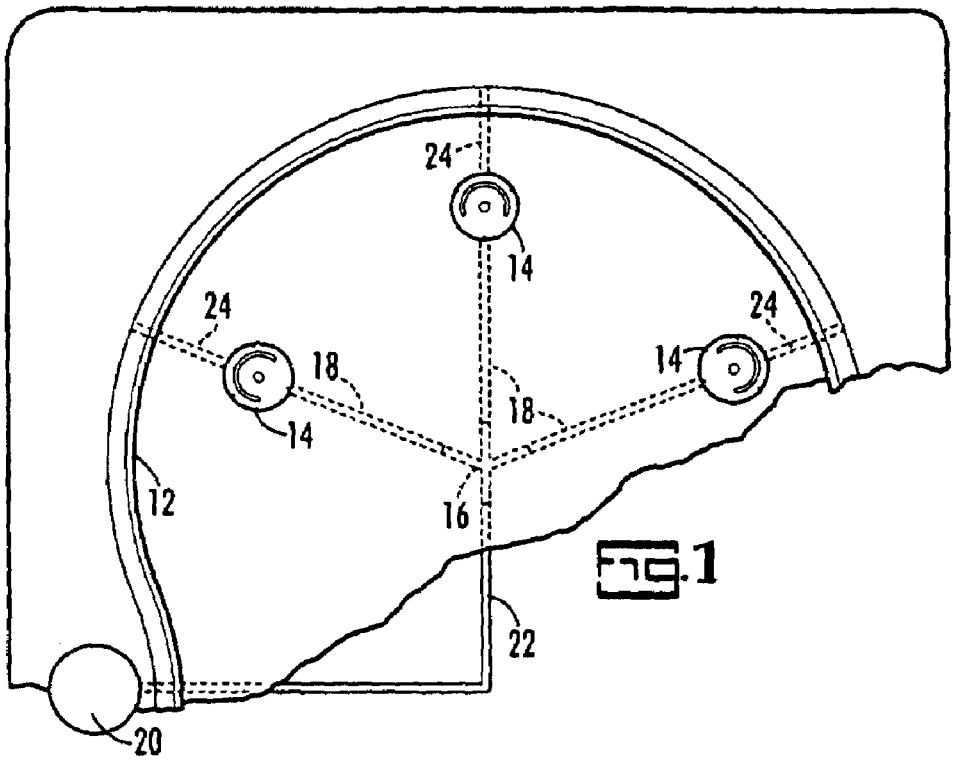
FIG. 1 is a top view of a portion of a swimming pool having a three main drain set, according to a preferred embodiment of the present invention.

FIG. 1 illustrates a top view of a portion of a pool 10. The portion of the wall 12 of pool 10 shown is curved and has a set of three drains 14 installed in the floor of the pool. Each main drain 14 is connected to a "double Y" connector 16 by an intermediate line 18 and double Y connector 16 is in turn connected to a canister filter 20 by a main line 22. Each main drain 14 is also connected by a relief line 24 to a relief port (not shown) in the wall 12 of pool 10 so that, if drain 14 is blocked, water will be sucked from pool 10 through drain 14's relief port.

Each drain 14 is subject to approximately equal suction, which can be achieved by arranging for drains 14 to be connected through intermediate lines 18 of approximately equal lengths from main line 22 or by adjusting the inner diameter and lengths of intermediate lines 18 based on standard engineering calculations so that the volume of water entering each drain 14 is equal. In this way, the intake of drains 14 of the set is balanced so as not to exceed the capacity of main line 22 running back to canister filter 20. Furthermore, the total volume of water that can be pumped to canister filter 20 should equal the volume of water entering the opening 26 of drains 14. Intermediate lines 18 and main line 22 running to canister filter 20 may be made of flexible conduit as long as the wall strengths of intermediate lines 18 and main line 22 are sufficient for the suction applied.

Drains 14 connected to the ends of the intermediate lines 18 are preferably those described in co-pending, commonly-owned patent application Ser. No. 11/109,599 filed Apr. 19, 2005, and incorporated herein in its entirety by reference. However, drains such as the MDX drain manufactured by Paramount Pool & Spa Systems can be used as well. Drains 14 preferably have relief lines 24 terminating at the relief ports in wall 12 of pool 10 so that, if any drain 14 becomes blocked, suction is diverted to the relief port of pool 10, away from drain 14 itself, thus terminating the suction to opening 26 of drain 14. The purpose of relief line 24 is to reduce the possibility of entrapment of swimmers. Of course, the blocking of a single drain 14 of a set of at least two drains 14 also increases suction to the other drains 14, which also relieves suction on the blocked drain 14.

Figure 2:
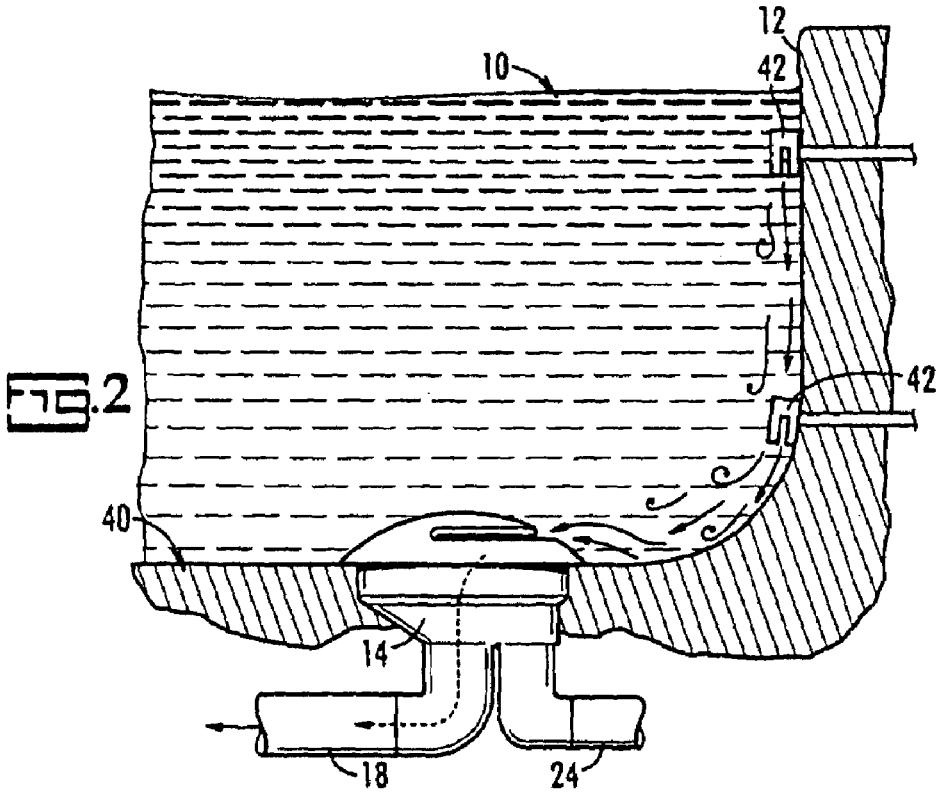
FIG. 2 is a side, partial cross-sectional view of a swimming pool showing a main drain and wall jets, according to a preferred embodiment of the present invention.

FIG. 2 illustrates a cross sectional view of a portion of swimming pool 10. Wall 12 of pool 10 meets the floor 40 of pool 10 preferably in a smooth gradual curve rather than in a sharp corner. Mounted to wall 12 of pool 10 are jet nozzles 42 oriented to project a high-pressure stream of return water downward along wall 12 to sweep sediment downward from the area of wall 12 in the vicinity of jet nozzle 42. Jet nozzles 42 may be stationary nozzles but are preferably carousel-type nozzles that rotate from side to side so that they dislodge and sweep sediment over a wide area of wall 12 and with more force than stationary nozzles. Jet nozzles 42 may be arranged in banks with some at higher elevations and some at lower elevations so that the higher nozzles 42 sweep sediment down to the lower nozzles 42, and the lower nozzles 42 sweep sediment to floor 40 of pool 10. Nozzles 42 may be sequenced so that the upper nozzles 42 are activated first for a short time, then lower nozzles 42 are activated and the upper ones are deactivated. Switching from the upper bank of nozzles 42 to the lower bank may be done using valves or using different pumps for each bank.

Sediment swept by nozzles 42 down wall 12 of pool 10 is drawn into opening 26 in drain 14 on floor 10 and carried to canister 20 via intermediate line 18 and main line 22. Although using wall nozzles 42 to sweep sediment down wall 42 and onto floor 40 for suction into drain 14 is known, providing drains 14 in sets of at least two, preferably two or three, allows drains 14 to be positioned closer to wall 12 and more effectively draw the swept sediment into the water circulation system than if fewer drains 14 are used. Furthermore, using drains 14 in sets connected by main line 22 to canister filter 20 rather than multiple drains each connected by individual lines, reduces the number of lines, the number of feet of piping, and the burden on circulation system components. Moreover, the type of drain shown, with one large, curved opening 26 that can be oriented to face wall 12 allows more efficient reception of the swept sediment. Drain 14 has an orientation bias that favors one side, and that draws sediment preferentially from that one side as opposed to being more or less omni-directional. Drain 14, in cooperation with the jet nozzles 14 on wall 12 of pool 10, helps to collect the sediment swept down from wall 12 and across a portion of floor 40 of pool 10.

The term "sets" of drains refers to two or more drains 14 that are connected ultimately to one main line 22 that in turn connects directly to a filter canister 20. To create a set of at least two drains 14, a "Y" or "double Y" or "multiple-Y" connector is used.

The cooperation of jet nozzles 42 on wall 12 and drains 14 located closer to the wall 12 in sets of two or more is an important feature of the present invention. In particular, the use of sets of at least two drains 14 allows the drains 14 to be closer to wall 12 where, in cooperation with the nozzles 42, they can more effectively remove sediment. Sediment enters the pool closer to wall 12, especially at points of entry such as steps and ladders, than at the center of pool 10 and will gradually migrate from there to the deepest part of floor 40 unless intercepted. The present invention intercepts sediment nearer to wall 12, and thus keeps pool 10 cleaner.

Figure 3:
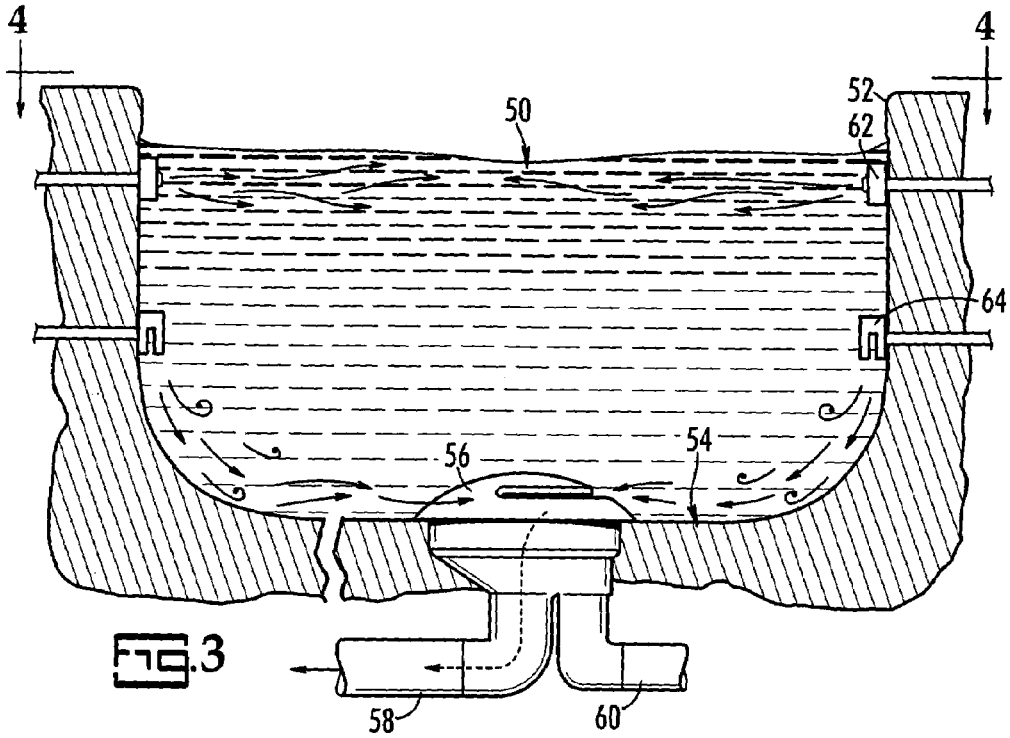
FIG. 3 is a side, partial cross-sectional view of a swimming pool showing a main drain and wall jets, according to an alternative embodiment of the present invention.
Figure 4:
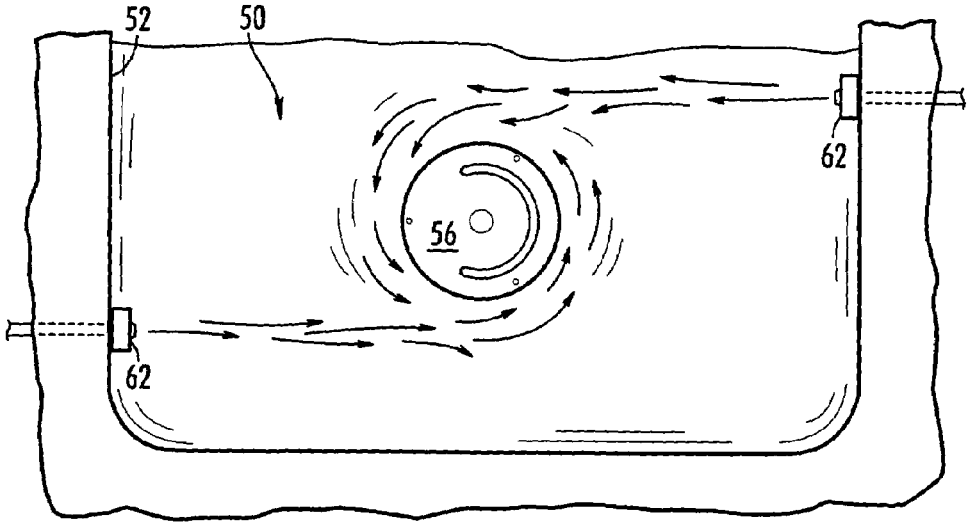
FIG. 4 is a partial top view of a swimming pool showing vorticular flow created by horizontal jets, according to a preferred embodiment of the present invention.

FIGS. 3 and 4 illustrate an alternative preferred embodiment of the present invention. In particular, as will be described, FIGS. 3 and 4 illustrate an alternative arrangement for jet nozzles.

FIGS. 3 and 4 show a pool 50 having a wall 52 and a floor 54. A drain 56 is mounted in floor with a line 58 to a canister (not shown) and another line 60 to a relief port (not shown) in wall 52. Pool 50 has jet nozzles oriented to direct a spray of water downward against wall 52 to sweep sediment to drain 56, as described in connection with FIG. 2. In the present embodiment, however, an upper set of nozzles 62 are arranged so that they direct a flow of water in a generally horizontal direction over drain 56. Preferably, nozzles 62 are arranged in pairs of opposing nozzles and offset or eccentrically arranged so that their opposing flows create a vortex over drain 56. Arrows in FIGS. 3 and 5 indicate the flow of water caused by nozzles 62.

In addition, a lower set of nozzles 64 sweeps sediment downward toward drain 56 as described above in connection with FIG. 2.

Figure 5:
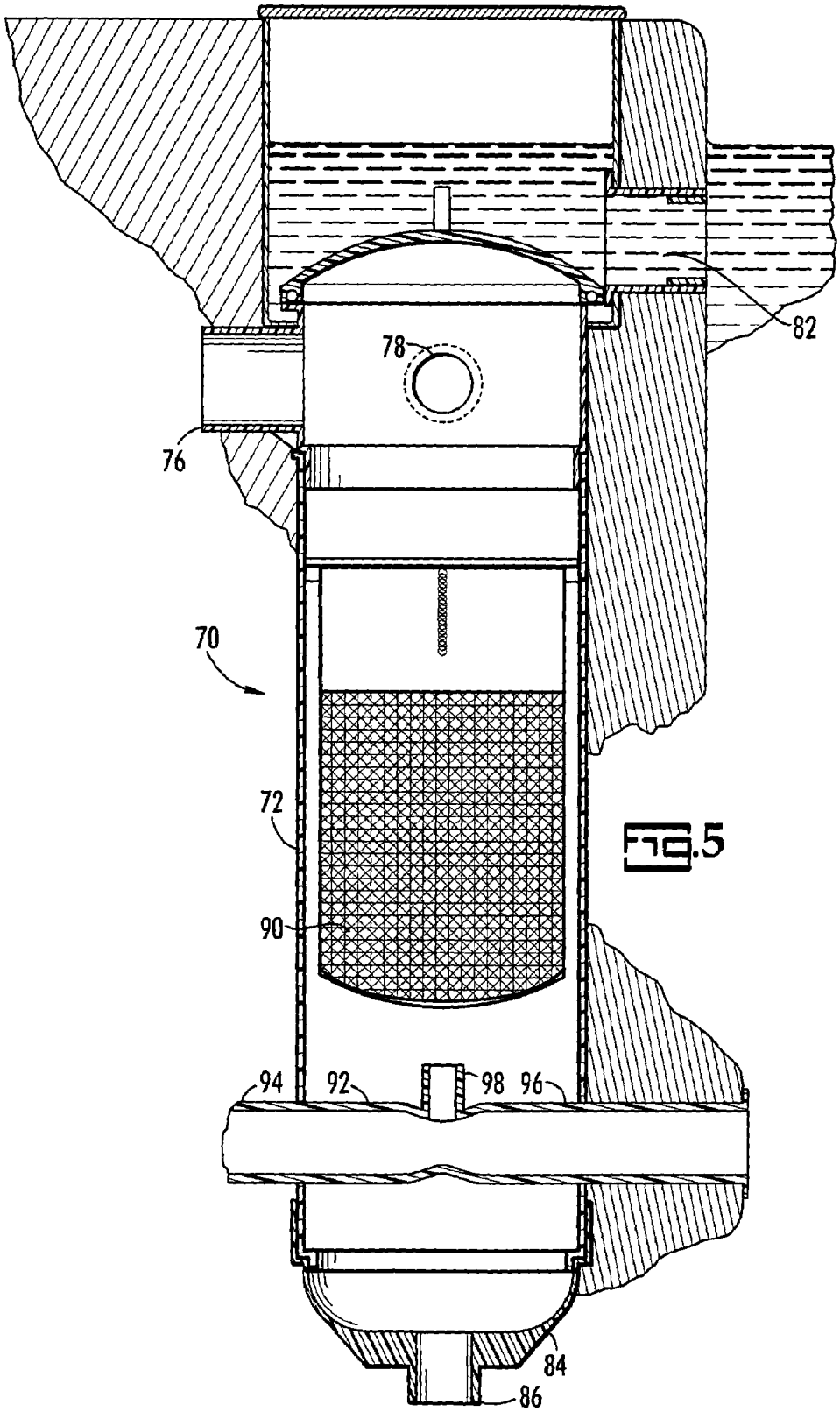
FIG. 5 is a side, cross sectional view of a canister for use with a swimming pool, according to a preferred embodiment of the present invention
Figure 6:
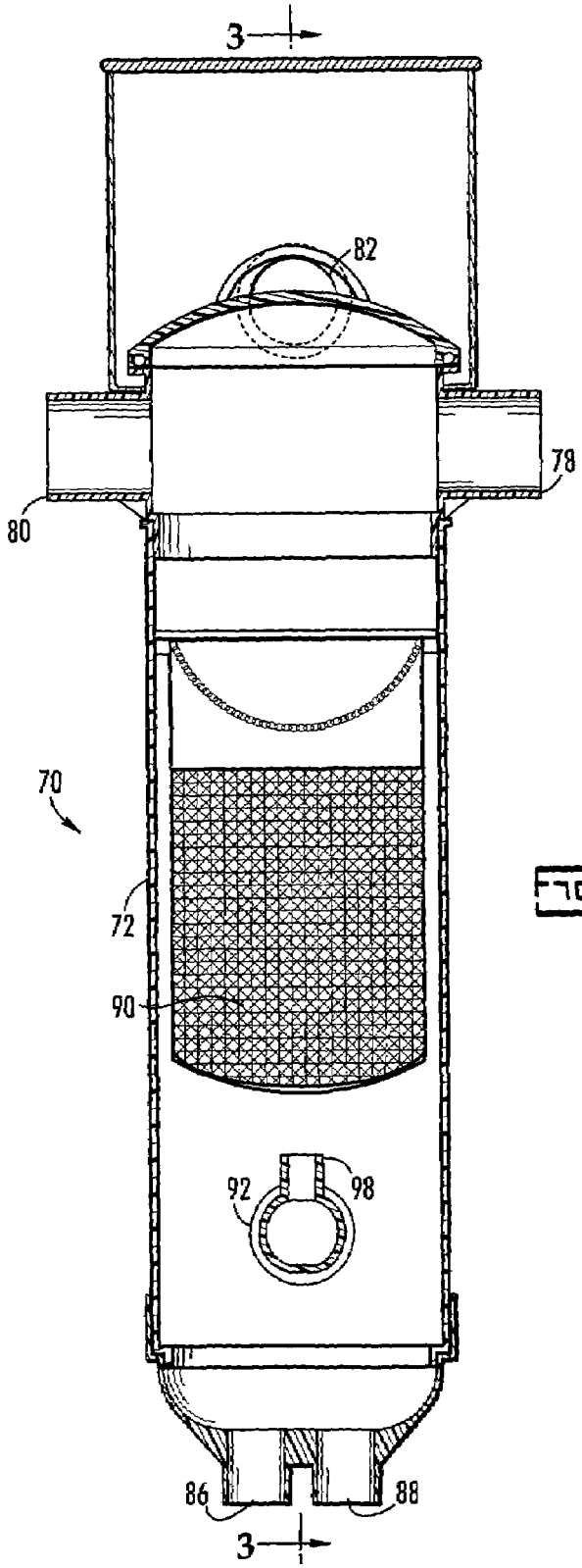
FIG. 6 is a side view of the canister of FIG. 5, rotated 90°, according to a preferred embodiment of the present invention.

FIGS. 5 and 6 illustrate a canister filter 70 for use in designing a pool and in the water circulation system of a custom-designed pool. Canister 70 includes a housing 72 through which water and sediment will pass from the pool on its way to the pumps (not shown).

Canister 70 has an upper manifold 74 with four fittings 76, 78, 80, and 82, two of which 76, 78, are for connecting to main drain lines, and a lower manifold 84 with two fittings 86, 88, one for each of two pumps. If one of the pump fittings 86, 88, is not in use, it may be capped off. In the lower part of housing 72, below upper manifold 74, is a mesh bag 90 for trapping sediment. Below sediment mesh bag 90, there may, in one preferred embodiment, be a venturi tube 92. Venturi tube 92 has an inlet 94 on one side of housing 72 and an outlet 96 on the opposing side of housing 72. A vent tube 98 is located inside housing 72. By connecting tube 98 to the pressure side of a pump through fitting 86 or 88, and flowing water through venturi tube 92, additional suction is provided through vent tube 98 as a result of the venturi effect. The water flowing through venturi tube 92 from inlet 94 to outlet 96 is returned to the pool.

A complete description of canister 70 is in commonly owned patent application Ser. No. 11/215,460, filed Aug. 30, 2005, incorporated herein by reference.

The additional fittings of the canister 70 compared to prior art canisters provide the designer with a convenient place to connect combinations of valves and pumps and drains for sediment collection and water management. Examples of this flexibility and the use of canister 70 in connection with sets of drains will now be presented and illustrated in FIGS. 7, 8, 9A and 9B and 10.

In custom pools of irregular shapes, larger sizes and special water features such as spas and fountains, there are potentially more places where sediment can build up unless the pool's water circulation system is designed to prevent these deposits. The pool water system designer, using the presently described features, has a large number of tools from which to choose: drains in sets, canisters with multiple fittings, suspended particle filters, skimmers, banks of horizontal and vertical jet nozzles, pumps, valves, robotic cleaners, and computer controllers. The selection of components presents a considerable range of choices and costs. Moreover, the piping to connect these components and the associated labor of laying it has a cost. Another factor to be considered in the design of the pool in addition to the selection of components for effective cleaning and the cost of connecting them, is the avoidance of running pipes under the pool to the extent possible, where subsequent repair may be costly.

The designer of the swimming pool water circulation system can start the design process by defining the shape of the pool to meet the contours of the land, trees, aesthetics and the homeowner's preferences. Then, the designer places main drains 110 in sets 118 of at least two, and preferably three, for thorough coverage of the floor 112 of pool 114, preferentially placing the drains in deeper areas, and nearer to the walls and other features where sediment is likely to enter the pool. The designer needs to keep the drains equi-distance from a "Y" or "double Y" connector 116 but can use flexible piping 120 to place drains where they are needed.

Once the main drains 110 are located in the design, the locations of jet nozzles 124 can be specified, as well as the number of banks of them. If pool 114 has a deep end, there may be two banks of nozzles 124, an upper one and a lower one, that both act to sweep sediment down pool wall 126 toward main drains 110. In a shallow region, one bank of nozzles 124 sweeping sediment down may be sufficient. Additional, horizontal jet nozzles 124 can be located closer to the pool surface for creating the vorticular flow over a main drain 110, as explained above and shown in FIGS. 3 and 4.

The jet nozzles are then grouped in zones 130 that may be operated in sequence. To properly sequence zones 130 of nozzles 124, a hydrovalve 132 can be used that permits plural, preferably six, zones 130, and will cycle through the six zones one at a time. If there are sufficient nozzles 124, more than one hydrovalve 132 can be used to control them. Therefore the designer may divide pool wall 126 into six roughly equal zones 130, for convenience. Banks of fixed or carousel-type jet nozzles 124 can then be assigned to operate on pool wall 126 within each zone 130, directing sediment toward the floor or creating vorticular flow. Typically, one set 118 of at least two main drains 110 can be defined for serving each zone 130 and located near the pool wall 126 so that they intercept the sediment as it is swept down pool wall 126 by the nozzles 124 of that zone 130.

Depending on the size and shape of pool 114, one, two or more sets 118 of at least two main drains 110 will be needed for sufficient coverage to keep pool 114 substantially clean most of the time.

Figure 7:
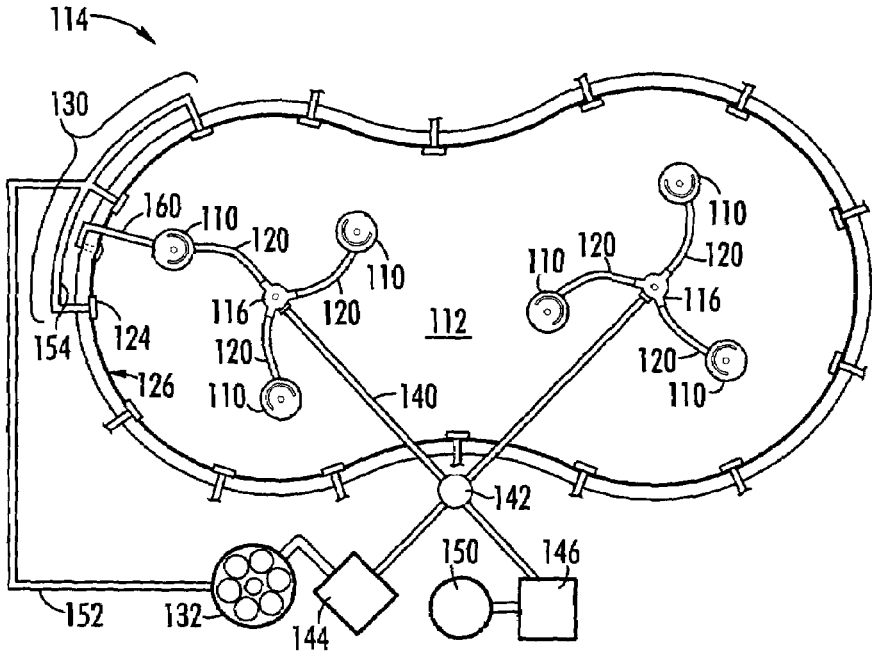
FIG. 7 is a schematic view of a pool with an irregular shape and having a water circulation system according to a preferred embodiment of the present invention.

FIG. 7 shows pool 114 with two sets 118 of three main drains 110. Each set 118 of main drains 110 is connected by a main line 140 to a single canister 142 that can be served by two pumps 144, 146. Pump 144 is connected to the suspended particulate filter 150 and then to return lines (not shown). Pump 144 may also be connected via its suction or pressure side to a robotic cleaner (not shown) or, via the output side of filter, to a robotic cleaner with a booster pump, as known in the prior art. Robotic cleaners are not shown in FIG. 7 in order to simplify it but are described below. In addition, second pump 146 is connected to six-port hydrovalve 132 and returns water to the pool through jet nozzles 124 in each of the six zones 130. Except for one line 152 to one zone 130, the lines to jet nozzles 126 from each of the six ports of hydrovalve 132 are not shown in order to simplify FIG. 7. However, it will be clear that a line would run from each of the six ports of hydrovalve 132 to a manifold 154 near pool wall 126 at each zone 130 and thence to the jet nozzles 124 of that zone 130, as shown in the one zone illustrated. Also, except for one relief line 160, the relief line from each main drain is not shown to simplify the drawing but each would run to pool wall 142 from drain 110 for which it provides relief.

In the pool shown in FIG. 7, the water circulation system can operate in two modes: normal operation and cleaning mode. In normal operation, first pump 144 sucks water from six main drains 110 through canister filter 142, passes it from its pressure side through the suspended particulate filter 150, and returns it to the pool through the usual return lines (not shown). In cleaning mode, second pump 146 turns on and sucks water from six main drains 110 through canister filter 142 and thence in sequence through each one of the six ports of hydrostatic valve 132 to each of the six zones 130 of jet nozzles 124. Nozzles 124 sweep sediment down pool wall 126 and toward six main drains 110. From drains 110, the sediment travels to canister filter 142 where it is captured in mesh bag inside the canister filter housing (see FIG. 3).

Figure 8:
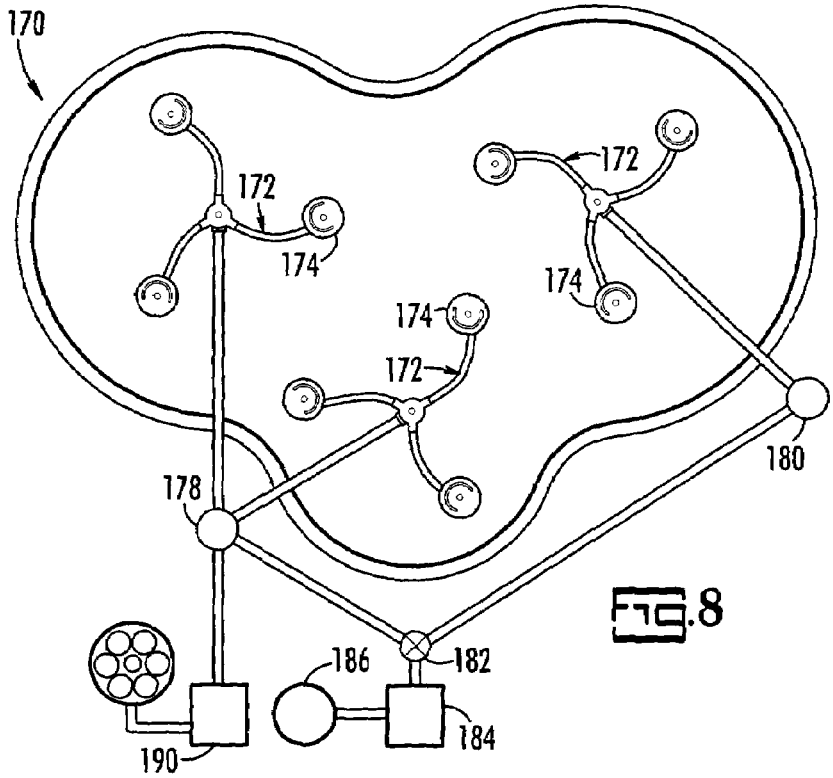
FIG. 8 is a schematic view of another pool with an irregular shape and having a water circulation system according to a preferred embodiment of the present invention.

FIG. 8 illustrates a larger pool 170 that requires three sets 172 of main drains 174 and thus two canister filters 178, 180. Canister filter 178 serving two of the sets 172 of main drains 174 and the other canister 120 serving the remaining set 172 of main drains 174. Jet nozzles and the lines to them have been eliminated for the simplicity of the drawing but would operate in a manner similar to that discussed in connection with FIG. 7. A second pump fitting of the second canister 180 would be capped off since it is not needed and a valve 182 would be placed between a first pump 184 and the first and second canisters 178, 180, so that first pump 184 could apply suction to either one or both and flow water through filter 186. A second pump 190 draws water from the two sets 172 of main drains 174 it is connected to and feeds it to a hydrovalve 192, which in turn distributes the water to six zones of jet nozzles around the pool wall (not shown in FIG. 8 for simplicity but the same as shown in FIG. 7). In a still larger pool, rather than increase the number of jet nozzles per zone or spread them farther apart, a second hydrovalve can be used.

Second pump 190 may be used to augment suction to the two sets 172 of drains 174 served primarily by first pump 184 when the zones of jet nozzles nearest those drains 174 are activated, and then be switched using valve 182 to the third set 172 of drains 174 upon the activation of the zones near the third set 172.

In addition to the use of two or three-drain sets for enabling the swimming pool water circulation system designer to move the drains closer to the walls to intercept sediment being swept down the walls by the jet nozzles, and the canister filter that can be connected to two pumps and two sets of drains, and which may also be connected to the pressure side of the pump to increase suction in the canister housing an alternative embodiment having an internal venturi tube, the designer can often substitute pumps for valves in the design.

Pumps and valves both control flow. A closed valve prevents flow until it is opened; a pump can also prevent flow until is it turned on. A pump is mechanically equivalent to a valve in many applications and functions like a motorized valve, alternating continuously between blocking and enabling fluids to flow as it does work on fluids to create flow.

The equivalence of pumps and valves is illustrated in FIGS. 9A and 9B. FIGS. 9A and 9B both illustrate portions of a swimming pool water circulation system. Both portions illustrated accomplish the same purposes; that is, they support a canister 210, a skimmer 212 and a hydrostatic six-port valve 214 for directing pool water for up to six zones of jet nozzles. The arrangement shown in FIG. 9A, however, accomplishes these purposes with one pump 218 and two valves 220, 222. The arrangement in FIG. 9B accomplishes these purposes with two pumps 228, 230, and no valves. The designer of the pool water circulation system may favor pumps over valves or vice versa depending on cost considerations, durability, piping requirements, service cycle considerations, and preference.

Pump 218 draws water from either canister 210 or skimmer 212 or both depending on the position of valve 220 between them and forwards it either to the pool return or to hydrostatic six-port valve 214 depending on the position of valve 222. In FIG. 9B, pump 228 draws water through canister 210 and returns it through the hydrostatic six-port valve 214; pump 230 draws water through skimmer 212 and returns it through the normal pool return.

A swimming pool designer, in determining the pool requirements may take advantage of an additional pump to eliminate a valve or vice versa and thereby save on equipment or pool operation costs as illustrated in FIGS. 9A and 9B.

FIG. 10 illustrates in schematic form a pool design that includes two pumps 240, 242 served by one canister 244 that is connected to two three-drain sets 246, 248. Pump 240 serves a skimmer 250 when valve 254 is opened, and directs its pressure side water to the suspended particulate filter 252 and pool return, or, alternatively when a valve 260 is opened, to a robotic cleaner (not shown).

Pump 242 returns water through a hydrostatic six-port valve 264 and then to wall jets (not shown in FIG. 8). However, a portion of the water flow may be diverted by a valve 266 through a venturi inside the housing of canister 244 and back to the pool through a simple return line 270. The venturi increases suction inside canister 244 and allows it to serve main drains sets 246, 248, better.

Preferably managing these various components is a controller 280, with electrical lines, 282, 284, 286, 288, 290, 292 to each pump and valve. Controller 280 is preferably programmable either by a technician or pool caretaker, most preferably with manual override for special cleaning needs. Of course, the management of the components can always be entirely manual.

FIGS. 11-15 illustrate different swimming pool water circulation systems. Each system has certain components in common: namely a set 300 of main drains, a robotic cleaner 302, a skimmer 304, a canister 306, a controller 308 and a filter 310. Note that like reference numbers are used throughout this series of figures to simplify the understanding of the various water circulation systems.

Controller 308 is essentially an electrical or electrical-mechanical device for opening and closing valves and switches on pumps at the user's direction or subject to a programmable device. Controller 308 is tied electrically to those components it controls and preferably provides a convenient user interface for the user to activate those components desired or to program the programmable device in accordance with a preferred schedule.

In each water circulation system, set 300 of drains draws water and sediment from the pool floor from fixed locations. When desired, sediment not responsive to set 300 can be vacuumed from the pool floor by roving robotic cleaner 302. Meanwhile floating debris is drawn into skimmer 304. Water returns from filter 310 via line 312

Figure 11:
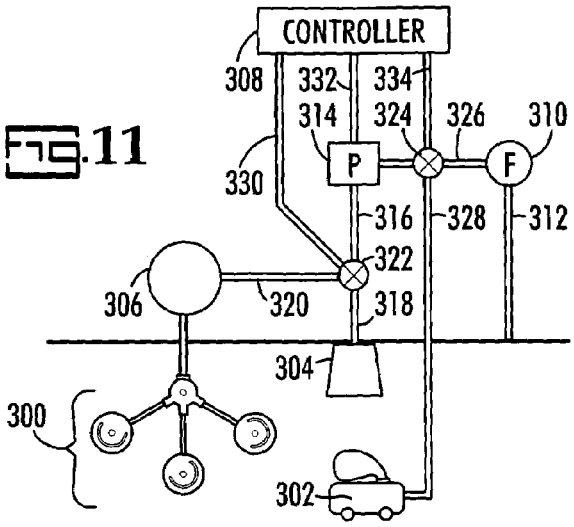
FIGS. 11-15 illustrate a series of water circulation systems for a given swimming pool, illustrating alternative embodiments possible with the present invention.

In FIG. 11, one pump 314, connected via lines 316 and 318 to skimmer 304 and to canister 306 via lines 316 and 320 on the suction side, pumps the pool water, removed of much of its sediment by the filter mesh bag in canister 306, to filter 310 through line 322. A valve 322 connects lines 316 and 318 and allows the user to control the flow of water to pump from canister 306 or skimmer 304 or both. Another valve 324 in line 326 leads to pressure side robotic cleaner 302 via line 328. Valves 322 and 324, as well as pump 314, are controlled by controller 308 via electrical lines 330, 332, and 334.

Figure 12:
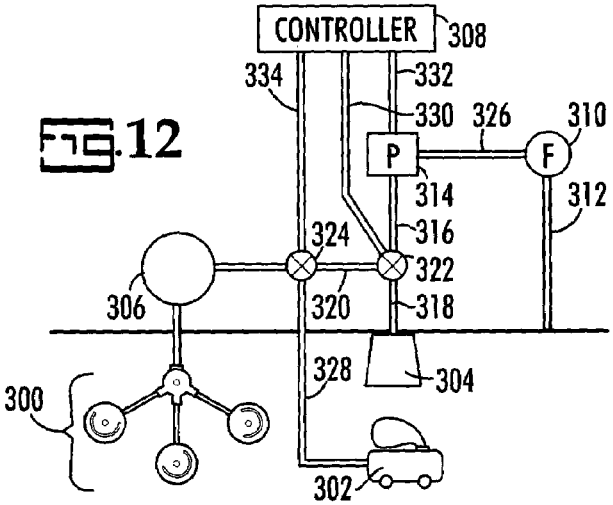

In FIG. 12, valve 324, robotic cleaner 302, and its line 328 are shown having been moved to the suction side of pump 314 from its pressure side as shown in FIG. 11. Valve 324 is now seen connected to pump 314 via line 320 and controls the suction side flow from robotic cleaner 302 through line 328.

Figure 13:
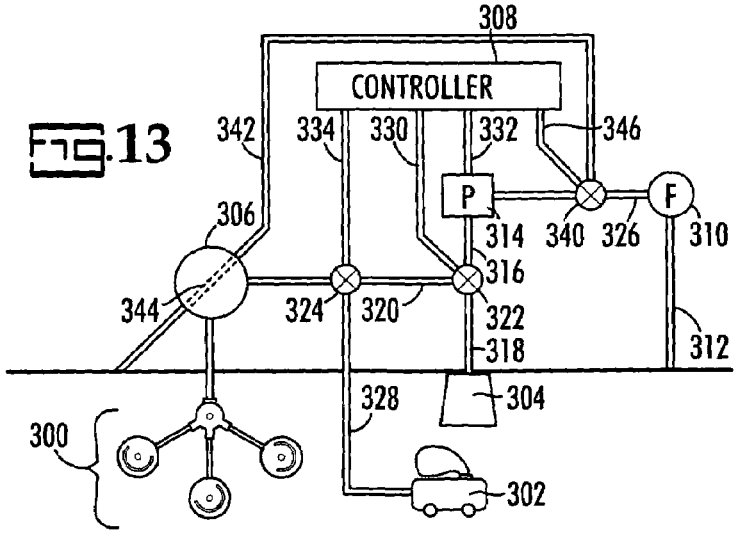

FIG. 13 illustrates a variation of pool circulation system shown in FIG. 12, in which robotic cleaner 302 is still on the suction side of pump 314 as in FIG. 12, but now a third valve 340 on pressure side of pump 314 directs a flow of water via line 342 to canister 306 through a venturi 344, as described above in connection with FIG. 5, to increase suction from canister 306 to set 300 of drains. Electrical line 346 controls operation of valve 340.

Figure 14:
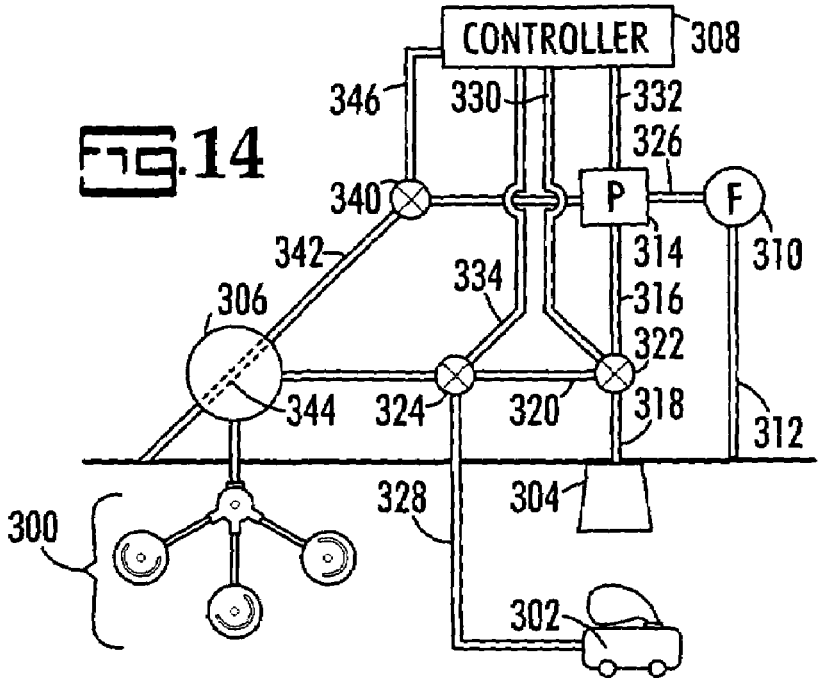

FIG. 14 presents a variation of the pool water circulation system shown in FIG. 13, in which valve 340, which was on the pressure side of pump 314, has been moved to the suction side so that a flow of water from the pool can pass through venturi 344 and line 342, and thereby increasing suction to set 300 of drains through canister 306.

Figure 15:
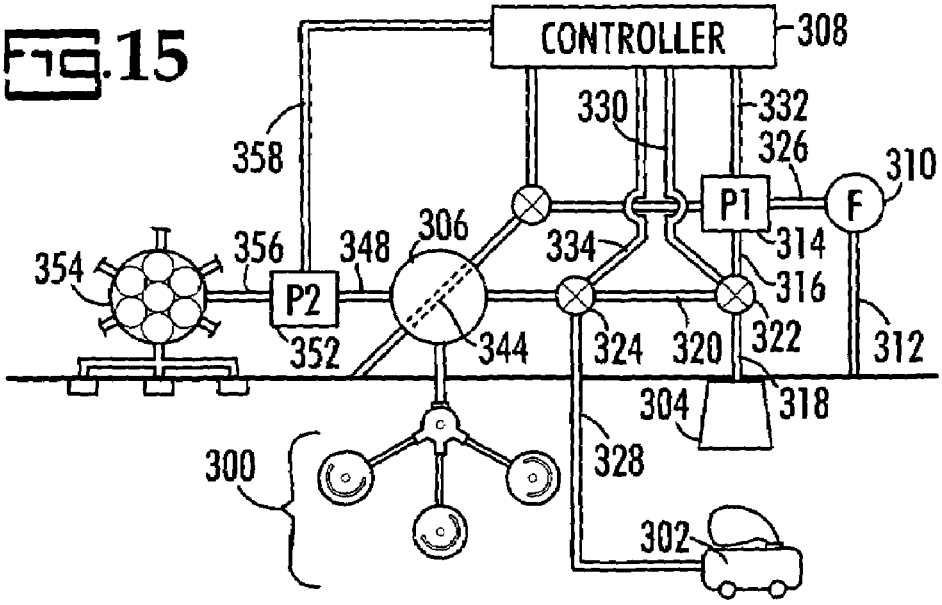

FIG. 15 illustrates a variation of the system shown in FIG. 14. In particular, instead of one pump 314, there is a first pump 350 and a second pump 352, both connected to canister 306. First pump 350 takes the place of pump 314 of FIG. 14, and second pump 352 is connected via line 348 to canister 306 and thence to a six port hydraulic valve 354 via line 356. Second pump is controlled by controller 308 via an electrical line 358. Hydraulic valve 354 sequentially delivers water to each of up to six manifolds 360 that operate wall jet nozzles 362 for sweeping sediment down the sides of the pool, as described above in connection with FIGS. 2 and 7, above.

The swimming pool water circulation system designer, in view of the foregoing, now has several novel tools to create the appropriate pool design. There is the set of two or three drains connected with a "Y" or a "double Y" connector that will allow drains to be placed closer to the walls of the pool where they can better intercept sediment swept down the walls by one or two banks of jet nozzles. There is the canister than can service two sets of two or three drains simultaneously and be connected to up to two pumps. For augmenting the suction provided by the one or two pumps connected to the canister during routine operation or when special demands are placed on the canister, a flow of water can be diverted from the pressure side of the pump through a venturi inside the canister housing to increase suction through the canister mesh bag. Horizontal wall jets in offset pairs can be used to create vortexes over active drains to increase their effectiveness. Finally, the pool water circulation system designer can select pumps and valves in the preferred combination to manage the water flow and the changes in the flow required in routine and cleaning operations. Where pumps are not available or not cost-effective, valves can be used to create a flow of water; conversely, where valves are not cost-effective, an additional pump can be used.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art of swimming pool water circulation systems from the foregoing description of the preferred embodiments without departing from the spirit of scope of the present invention.

What is claimed is:

1. A swimming pool, comprising:

a bowl having an interior, a floor and a wall, said bowl adapted for holding water;

a circulation system in fluid communication with said interior of said bowl, said circulation system having plural pipes, a pump having a suction side and a pressure side, means for filtering particulate from said water, and a set of at least two drains located in the floor of said bowl, said suction side of said pump being connected by said plural pipes to said set of at least two drains and said particulate filtering means so that said water in said bowl can be drained through said set of at least two drains and through said particulate filtering means, said set of at least two drains being connected to one pipe of said plural pipes via a Y connection having two lines on one side and a line on an opposing side of said Y connection, said one pipe being positioned between said set of at least two drains and said particulate filtering means, so that said set of said at least two drains can be connected to said two lines on one side of said Y connection and said one line on said other side leads to said filtering means; and jets mounted to said wall of said bowl and connected to said pressure side of said pump, said jets returning water drained from said bowl to said bowl and sweeping particulate down said wall to said floor of said bowl as said jets return said water to said bowl.

2. The swimming pool as recited in claim 1, wherein said set of at least two drains is deployed about said floor so as to receive particulate swept down said wall by said jets.

3. The swimming pool as recite in claim 1, wherein each drain of said set of at least two drains is located an equal distance from said one pipe.

4. The swimming pool as recited in claim 1, wherein said particulate filtering means is a canister filter and said one pipe is connected to said canister so that said set of at least two drains drain water through said canister filter.

5. The swimming pool as recited in claim 4, wherein said canister filter has a housing and a venturi formed in said housing, said venturi being connected to said pressure side of said pump and to said bowl so that a flow of water from said pressure side of said pump through said venturi augments suction through said canister from said suction side of said pump.

6. A swimming pool, comprising:

a bowl dimensioned for use for swimming and having a wall and a floor;

a first canister filter;

a pump having a suction side and a pressure side, said suction side being in fluid communication with said first canister filter;

a first set of at least two drains mounted in said floor of said bowl proximate to said wall;

plural jets carried by said wall of said bowl, said jets being connected to said pressure side of said pump;

piping connecting said first canister filter, said pump, said first set of at least two drains and said plural jets so that water can be pumped by said pump from said first canister filter to said plural jets and from said first set of said at least two drains to said first canister filter, and said water, when sprayed from said jets, washing particulate down said wall, and said drains drawing said particulate into said first set of at least two drains, whereupon said particulate flows with said water to said first canister filter, said piping including a first Y connector having at least two lines on one side and one line on an opposing other side of said first Y connector, so that said first set of at least two drains can be connected to said at least two lines on one side of said first Y connector and said one line on said other side leads to said first canister filter.

7. The swimming pool as recited in claim 6, further comprising:

a second set of at least two drains; and a second Y connector having at least two lines on one side and one line on an opposing side of said second Y connector, said second set of at least two drains being connected to said at least two lines of said one side of said second Y connector, and said opposing side of said second Y connector being connected to said first canister filter, said jets washing particulate from said wall of said bowl to said second set of drains.

8. The swimming pool as recited in claim 7, wherein said plural jets further comprise a first set of jets proximate to said first set of drains and a second set of jets proximate to said second set of drains.

9. The swimming pool as recited in claim 7, further comprising:

a controller; and valve means in operational connection with said controller so that said controller opens and closes said valve at predetermined times, and wherein said plural jets further comprise a first set of jets proximate to said first set of at least two drains and a second set of jets proximate to said second set of at least two drains, said first and said second sets of jets being in fluid communication with said pressure side of said pump, and wherein said valve means switches, as said valve opens and closes, between said first and said second set of jets and said first and second sets of drains.

10. The swimming pool as recited in claim 6, further comprising:

a second canister filter;

a third set of at least two drains; and a third Y connector having at least two lines on one side and one line on an opposing side of said third Y connector, said third set of at least two drains being connected to said at least two lines of said one side of said third Y connector, and said opposing side of said third Y connector being connected to said second canister filter, said jets washing particulate from said wall of said bowl to said third set of at least two drains.

11. A swimming pool, comprising:

a bowl having an interior, a floor and a wall, said bowl adapted for holding water; and a circulation system in fluid communication with said interior of said bowl, said circulation system including a canister;

at least two pumps, each pump of said at least two pumps having a suction side and a pressure side, said suction side of said each pump being in fluid connection to said canister, a filter in fluid connection with said pressure side of one pump of said at least two pumps, a filter mesh bag carried within said canister, a set of at least two drains located in the floor of said bowl and in fluid connection with said canister, a skimmer in fluid connection with one suction side of said at least two suction sides of said at least two pumps, and sets of jet nozzles carried by said wall of said pool and in fluid connection with said pressure side of said at least two pumps.

12. The swimming pool of claim 11, further comprising a robotic cleaner in fluid connection with said pressure side of at least one pump of said at least two pumps.

13. The swimming pool of claim 11, further comprising a robotic cleaner in fluid connection with said suction side of at least one pump of said at least two pumps.

14. The swimming pool as recited in claim 13, further comprising jet nozzles carried by said wall and in fluid communication with said at least two pumps.

15. The swimming pool as recited in claim 14, wherein said jet nozzles are arranged in banks on said wall.

16. The swimming pool as recited in claim 15, wherein said jet nozzles are arranged in two banks, one bank of said two banks being lower on said wall than another bank of said banks.

17. The swimming pool as recited in claim 16, wherein said another bank of nozzles is directed horizontally over drains of said set of drains to create vorticular flow.

18. A swimming pool, comprising:

a bowl having an interior, a floor and a wall, said bowl adapted for holding water; and a circulation system in fluid communication with said interior of said bowl, said circulation system having plural pipes, a pump having a suction side and a pressure side, means for filtering particulate from said water, and a set of at least two drains located in the floor of said bowl, said suction side of said pump being connected by said plural pipes to said set of at least two drains and said particulate filtering means so that said water in said bowl can be drained through said set of at least two drains and through said particulate filtering means, said set of at least two drains being connected to one pipe of said plural pipes via a Y connection having two lines on one side and a line on an opposing side of said Y connection, said one pipe being positioned between said set of at least two drains and said particulate filtering means, so that said set of said at least two drains can be connected to said two lines on one side of said Y connection and said one line on said other side leads to said filtering means, and wherein said particulate filtering means is a canister filter and said one pipe is connected to said canister so that said set of at least two drains drain water through said canister filter, and wherein said canister filter has a housing and a venturi formed in said housing, said venturi being connected to said pressure side of said pump and to said bowl so that a flow of water from said pressure side of said pump through said venturi augments suction through said canister from said suction side of said pump.

19. The swimming pool as recited in claim 18, further comprising jets mounted to said wall of said bowl and connected to said pressure side of said pump, said jets returning water drained from said bowl and sweeping particulate down said wall to said floor of said bowl as said jets return said water to said bowl.

20. The swimming pool as recited in claim 19, wherein said set of at least two drains is deployed about said floor so as to receive particulate swept down said wall by said jets.

21. The swimming pool as recite in claim 18, wherein each drain of said set of at least two drains is located an equal distance from said one pipe.

* * * * *